US010458238B2

(12) United States Patent
Hoffmann

(10) Patent No.: US 10,458,238 B2
(45) Date of Patent: Oct. 29, 2019

(54) ROTARY PISTON ENGINE AND METHOD FOR OPERATING A ROTARY PISTON ENGINE

(71) Applicant: Fuelsave GmbH, Walldorf (DE)

(72) Inventor: Dirk Hoffmann, Buchholz i.d.N. (DE)

(73) Assignee: Fuelsave GmbH, Walldorf (DE)

( * ) Notice: Subject to any disclaimer, the term of this patent is extended or adjusted under 35 U.S.C. 154(b) by 29 days.

(21) Appl. No.: 15/761,213

(22) PCT Filed: Sep. 16, 2016

(86) PCT No.: PCT/EP2016/071937
§ 371 (c)(1),
(2) Date: Mar. 19, 2018

(87) PCT Pub. No.: WO2017/050648
PCT Pub. Date: Mar. 30, 2017

(65) Prior Publication Data

US 2018/0258768 A1 Sep. 13, 2018

(30) Foreign Application Priority Data

Sep. 21, 2015 (EP) ..... 15186100

(51) Int. Cl.
*F01C 1/14* (2006.01)
*F01C 1/12* (2006.01)
(Continued)

(52) U.S. Cl.
CPC ..... *F01C 1/123* (2013.01); *F01C 19/06* (2013.01); *F01N 5/04* (2013.01)

(58) Field of Classification Search
CPC ..... F01C 19/025; F01C 1/123; F01N 3/00
See application file for complete search history.

(56) References Cited

U.S. PATENT DOCUMENTS 1,426,820 A * 8/1922 Crawford ..... F04C 2/36 418/191
2,604,051 A * 7/1952 Johnson ..... F04C 2/084 418/190

(Continued)

FOREIGN PATENT DOCUMENTS

DE 2635972 A1 2/1978
DE 4439063 A1 6/1995

(Continued)

OTHER PUBLICATIONS

DE 102007019958 A1 English Translation (Year: 2008).*
PCT/EP2016/071937, International Preliminary Report on Patentability, 5 pages.

*Primary Examiner* — Mark A Laurenzi
*Assistant Examiner* — Shafiq Mian
(74) *Attorney, Agent, or Firm* — Hoffman Warnick LLC

(57) ABSTRACT

The invention relates to a rotary piston engine comprising a housing which forms an interior space, two rotary pistons which are arranged in the interior space, an inlet opening for introducing a fluid into the interior space, and an outlet opening for the fluid, which is located in the interior space on a side opposite the inlet opening. Each rotary piston comprises at least two sealing strips and at least two recesses on the outer circumference thereof, wherein the shapes of the recesses and the sealing strips are selected to engage the sealing strips of a respective rotary pistons in the recesses of the respective other rotary piston. In addition, the sealing strips are dimensioned in the radial direction to sealingly contact an inner wall of the housing. The invention also relates to a corresponding method for operating a rotary piston engine.

14 Claims, 1 Drawing Sheet

(51) Int. Cl.
*F01C 19/06* (2006.01)
*F01N 5/04* (2006.01)

(56) References Cited

U.S. PATENT DOCUMENTS

| | | | | | |
|---|---|---|---|---|---|
| 4,165,209 | A * | 8/1979 | Eiermann | F01C 1/123 | 418/190 |
| 4,646,693 | A * | 3/1987 | Fayngersh | F02B 53/00 | 123/214 |
| 5,529,026 | A * | 6/1996 | Kurr | B60H 1/00485 | 123/41.1 |
| 7,347,048 | B2 * | 3/2008 | Albat | F02B 37/005 | 137/625.47 |
| 7,628,015 | B2 * | 12/2009 | Marumoto | F02B 33/34 | 60/607 |
| 8,215,935 | B2 * | 7/2012 | Dehlsen | F01C 1/20 | 123/241 |
| RE45,397 | E * | 3/2015 | Van Blaricom | F01C 1/123 | 123/237 |
| 9,732,681 | B2 * | 8/2017 | Haughton | F01N 5/04 | |
| 2011/0000208 | A1 * | 1/2011 | Robinson | F02B 37/001 | 60/602 |
| 2013/0209306 | A1 * | 8/2013 | South | F01C 1/084 | 418/104 |
| 2015/0361874 | A1 * | 12/2015 | Robinson | F02B 37/004 | 415/1 |

FOREIGN PATENT DOCUMENTS

| | | | | |
|---|---|---|---|---|
| DE | 102007019958 | A1 * | 2/2008 | F01C 1/123 |
| DE | 102007019958 | A1 | 2/2008 | |
| FR | 698019 | A | 1/1931 | |
| GB | 576603 | A | 4/1946 | |

* cited by examiner

ROTARY PISTON ENGINE AND METHOD FOR OPERATING A ROTARY PISTON ENGINE

FIELD OF THE INVENTION

The present invention relates in a first aspect to a rotary engine.

In a second aspect, the invention relates to a method for operating a rotary engine.

RELATED ART

A rotary engine serves for converting energy into rotational energy. Rotary engines on which the invention is based are set in motion by the pressure of a fluid. The fluid can in general be arbitrary and the pressure can also be produced in substantially any arbitrary manner.

A generic rotary engine comprises a housing which forms an inner room. At least two rotary pistons are arranged in the inner room. Furthermore, an inlet opening is provided for introducing a fluid into the inner room, and an outlet opening for the fluid is provided, the outlet opening being arranged at the inner room at a side opposite to the inlet opening. The fluid thus flows through the inner room and thus makes the rotary pistons rotate.

Similarly, a generic method for operating a rotary engine comprises the step of introducing a fluid through an inlet opening into an inner room of a housing of the rotary engine. At least two rotary pistons are arranged in the inner room and are set into rotation by the fluid.

Many rotary engines are known which operate according to this principle. Most of these engines are designed for a specific working fluid and are often also designed for a comparably small range of working pressures of the fluid. Known rotary engines also set narrow boundaries in particular with respect to the viscosity of the working fluid. Furthermore, known rotary engines often have an efficiency that is worthy of improvement at low working pressures.

SUMMARY OF THE INVENTION

It can be regarded as an object of the invention to provide a rotary engine and a method for operating a rotary engine wherein the rotary engine provides a particularly high efficiency in a particularly broad field of applications.

This object is solved with the rotary engine, and the method disclosed herein.

Variants of the rotary engine of the invention of the method of the invention are subject-matter of the dependent claims and are also illustrated in the following description.

According to the invention, the rotary engine of the above-referenced kind comprises at least two sealing strips and at least two recesses at the outer circumference of each rotary piston. The shapes of the recesses and the sealing strips are chosen for engaging, in particular sealingly engaging, of the sealing strips of one rotary piston with the recesses of the other rotary piston, respectively. Furthermore, the sealing strips are radially sized for sealingly contacting a housing inner surface.

Similarly, in the method of the above-referenced kind, each rotary piston comprises at its outer circumference at least two sealing strips and at least two recesses, wherein the shapes of the recesses and of the sealing strips are chosen for engaging, in particular sealingly engaging, of the sealing strips of one rotary piston with the recesses of the other rotary piston, respectively. Furthermore, the sealing strips are radially sized for sealingly contacting a housing inner surface. A radial direction refers to the radius of the corresponding rotary piston, and thus the radial direction is traverse or perpendicular to the rotary direction of the respective rotary piston. The fluid coming from the inlet opening pushes against (at least) some of the sealing strips, thus pushing these sealing strips against the housing inner surface. In particular, depending on a rotary position, at least one (or exactly one) of the sealing strips of each rotary piston may be exposed to incoming fluid and may thus be pushed against the housing inner surface.

It may be regarded as an idea of the invention to provide for a sealing of a rotary engine by means of sealing strips which are attached to or inserted at the rotary pistons. A fluid pressure acts on the sealing strips and pushes these against the inner surface of the housing, which produces a particularly good sealing. The fluid pressure thus leads to a certain deformation of the sealing strips which is important for an efficient sealing.

Such a deformation would not or hardly be possible if the whole outer circumference of a rotary piston were formed rigidly, in particular from the same material.

The sealing fluid pressure may already be reached at a comparably low pressure. Furthermore, the viscosity of the working pressure only plays a minor role. The rotary engine of the invention may thus be deployed for many different working fluids and under very different pressures. As a further advantage, depending on the deployed fluid, lubricants or lubricating oils are not required with the rotary engine of the invention.

A particularly good sealing may be achieved if the sealing strips comprise a deformable or elastic material so that the sealing strips may be pushed/deformed against the housing inner surface. The material of the sealing strips is easier deformable or more elastic than a material of the rotary piston surrounding the sealing strips, in particular easier deformable or more elastic than the material in which the slots for receiving the sealing strips are formed, which slots are described in more detail further below.

The deployed fluid may in general be any liquid or any gas, which enters the inner room of the rotary engine through the inlet opening. When flowing through the inner room into the direction of the outlet opening, the fluid rotates both rotary pistons. The rotary pistons are sized and positioned in the inner room such that the fluid can only flow from the inlet opening to the outlet opening if the rotary pistons are thereby rotated. In other words, the two rotary pistons provide for a sealing at standstill such that no fluid can flow through the inner room without rotation. For this sealing, a contact of the two rotary pistons is necessary. This contact provides that little or no fluid may pass through the two rotary pistons. On the other hand, also a contact of the two rotary pistons to the housing inner surface is necessary for said sealing. This contact is provided for at least at a side facing outwards of the respective rotary piston, which is opposite the contact area between the rotary pistons. For example, by means of its sealing strips, each rotary piston may provide for a sealing contact with a neighboring housing inner surface through an angle range of at least 150°, preferably at least 180 and particularly preferably more than 180°.

The sealing strips may extend in a longitudinal direction which is substantially parallel to the rotation axes of the two rotary pistons. In particular, an angle between the longitudinal direction and the rotation axes may be smaller than 20°, preferably smaller than 10°.

The two rotation axes of the two rotary pistons may be parallel to each other or at an angle which is not more than 40° or preferably not more than 20°. If asymmetric sealing strips are used, as described further below, the rotary pistons may be identical to each other except for a mirror-inverted design or shape.

A rotary piston may be understood as a component that is rotatably mounted and rotates a driveshaft when it rotates. The rotation of the driveshaft may then be used to rotate other components, for example, or in particular to drive a generator for generating electrical energy.

For attaching the sealing strips at the rotary pistons, the sealing strips may be accommodated in slots, i.e., grooves or similar recesses, formed at the respective outer circumference of the rotary pistons. The sealing strips may be attached in the slots in basically any manner. The sealing strips may thus be exchangeable, thus allowing easy replacement of the sealing strips when necessary because of wear due to the sealing contact; without the necessity to replace further components of the rotary engine.

In a variant, the sealing strips are formed as slot nuts for securely engaging with the slots in the rotary piston. This may be understood such that the sealing strips comprise a widening or a collar at their respective inner end which is received in the corresponding rotary piston. The slots which receive the sealing strips are formed such that said widening or collar securely engages.

In particular, the slots may be formed as T-slots and each of the slot nuts may comprise a laterally protruding collar for engagement with one of the T-slots. In a cross-section traverse or perpendicular to the rotation axis of the corresponding rotary piston, the slots may have the shape of a T. An end of the slot nuts facing the inner side of the rotary piston also has a T-shape such that the slot nuts are secured in the T-slot. In principle, threaded fasteners or adhesive attachments may also be provided for securing the sealing strips in the slots.

More generally but in particular in the above examples, the sealing strips and the corresponding slots may be formed such that the sealing strips are secured, i.e., cannot be moved, in a radial direction of the corresponding rotary piston. In contrast, in a perpendicular direction hereto, for example, in particular in the direction of the rotation axis of the rotary piston, a movement (and thus insertion and replacement) of the sealing strips may be possible. It is thus easily possible to replace worn or used sealing strips.

The sealing effect between the sealing strips and the housing inner surface depends on the deformation of the sealing strips. It may be preferable if the fluid pressure causes a deformation of the sealing strips towards the housing inner surface and not a deformation of the sealing strips away from the housing inner surface. Each of the sealing strips has a surface which faces incoming fluid, for a rotation angle position of the rotary piston at which the sealing strip contacts the housing inner surface. In the following, this surface is referred to as the fluid contact surface. For providing a deformation for sealingly contacting the housing inner surface, the fluid contact surface may have preferably not have a convex shape or at least may not have a convex shape at its end facing the housing inner surface. It may be preferable that the fluid contact surface may rather have a concave shape or at least may have a concave shape at its end facing the housing inner surface. Alternatively, also a substantially plane extension of the fluid contact surface may provide a sufficient deformation, depending on the circumstances.

Each sealing strip has a rear side opposite the fluid contact surface. This rear side does not face incoming fluid when a rotation angle position of the rotary piston is such that the sealing strip contacts the housing inner surface or is next to the housing inner surface. The shape of the rear side also has consequences on the deformation and thus sealing effect. It may be preferable that the rear side is not concave or at least not concave at an end facing the housing inner surface. It may be preferable that the rear side is convex or has a convex end facing the housing inner surface. A sufficient sealing effect may also be possible with a linear or even shape of the rear side.

The sealing strips may comprise an edge at which a sealing contact to the housing inner surface is achieved. An edge may result from a cross-section that is not rounded, in particular when the fluid contact surface is concave or the rear side is convex.

It may be preferable that each rotary piston comprises (in particular exactly) two sealing strips at opposite angle positions at its respective outer circumference. In particular, the two angle positions may be offset to each other by a rotation angle of 180° about the rotation axis of the corresponding rotary piston. Furthermore, each rotary piston may comprise two recesses which are located at the outer circumference at angle positions that are also offset to each other by 180°, and are preferably offset to the angle positions of the two sealing strips by 90°. This has the effect that incoming fluid always pushes against one of the sealing strips at each rotary piston and thus causes rotation of the rotary piston. Furthermore this design has the effect that a sealing of the two rotary pistons to the housing inner surface is provided independently from a current rotation position of the rotary piston.

The sealing strips may be sized and a housing inner surface may be formed such that the sealing strips sealingly contact the housing inner surface within a rotation angle range of the rotary piston. This rotation angle range may be opposite to a contact area between the two rotary pistons. Depending on the rotary position of the rotary piston, at least one of the sealing strips thus contacts the housing inner surface. It may be preferable that the shape of the housing inner surface is such that two sealing strips instead of just one sealing strip contact the housing inner surface over a rotary angle range, which may be between 5° and 20°, for example. Such an overlap ensures for all rotary positions that no fluid may pass the rotary pistons without rotating the rotary pistons.

Each rotary piston may comprise a gear rim at its outer circumference. The rotary pistons may be arranged such that its gear rims intermesh. This substantially prevents fluid from passing between the two rotary pistons. The fluid is rather guided at the edge/perimeter between the rotary pistons and the housing inner surface. The gear rims may be interrupted or broken by the recesses and the sealing strips, and otherwise may extend over the whole circumference of the two rotary pistons. A gear rim may be understood such that an outer circumferential surface of the corresponding rotary piston comprises radially protruding teeth. It may be preferable that each tooth extends over the whole height of the rotary pistons along their rotary axes.

In particular, temperature variations may slightly change the relative position between the two rotary pistons. The intermeshing/engagement of the gear rims may, however, provide a sealing effect also with such positional variations. In contrast, the gear rims would be unsuited to provide a sealing towards the housing inner surface. Here no intermeshing teeth are provided and thus positional variations would lead to leakage currents. To avoid this, a sealing to the housing inner surface is not provided with the gear rims but with the sealing strips.

Depending on a rotary position of the two rotary pistons, a substantially sealing contact between the rotary pistons is provided either by the intermeshing gear rims or by one of the sealing strips of one rotary piston which protrudes into one of the recesses of the other rotary piston.

In a radial direction, the sealing strips may protrude further outwards from the respective rotary piston than the respective gear rim. The gear rim is thus always spaced apart from the housing inner surface. A free space is thus formed in between, through which fluid is passed in the direction of the outlet opening. The free space is limited in the circumferential direction of the rotary pistons by the sealing strips.

The sealing strips protrude over the respective gear rim preferably by a radial distance which is between 5% and 30%, in particular between 10% and 25%, of a radius of the gear rim. This radius may be defined starting at the center point of the rotary piston to the outer circumference of the respective gear rim. The protruding radial distance affects the amount of a deformation of the sealing strip and thus affects sealing properties. Furthermore, the protruding radial distance is decisive for the amount of fluid that is led along/past the corresponding rotary piston. It has become evident that with the above-mentioned values a good sealing effect can be achieved and a high efficiency can be achieved over a comparably large span of flow rate amounts.

In some variants, a radial size of teeth of the gear rim is preferably not more than 15%, preferably not more than 10%, of a radius of the gear rim. In this way a fluid flow between the two gear rims is sufficiently reduced. Larger teeth may have, depending on the fluid, negative impacts of the fluid flow. The radius of the gear rim may be defined by the distance from its center point to its outer circumference, i.e., to the outermost end of the teeth.

In general the rotary engine may be used for any application purposes in which energy from a fluid pressure is used. Furthermore, heat energy may be used by transferring the heat energy to the fluid, eventually contributing to the fluid pressure which is used by the rotary engine for generating rotational energy. In particular, applications are envisaged in which rather moderate amounts of energy are to be harvested. An example is the usage of exhaust waste heat of a combustion engine, for example in a vehicle.

The invention thus also relates to a waste heat recovery system with a working fluid circuit or cycle in which the fluid circulates. Heat can be transferred from a medium to the fluid in the working fluid circuit through a heat exchanger. The medium may in principle be of any kind. For example, it may be exhaust gas of a combustion machine, in particular of a combustion engine of a vehicle. The working fluid circuit is designed as a thermodynamic cycle and comprises means for converting heat energy of the fluid into motion energy. Such cycles are in principle known. For example, the working fluid circuit may be designed as an organic Rankine cycle (ORC) and may comprise the components required for this. As a relevant feature, a rotary engine according to the invention is provided as the engine of the thermodynamic cycle (or: as the turbine that is used instead in such cycles). The passing-through fluid is relaxed in that engine and rotation of the rotary pistons is thus caused. Instead of an ORC process, also other thermodynamic cycles may be used, in which cycles an engine is driven by heat energy. The thermodynamic cycle may for example comprise a feed pump, a heater or the heat exchanger, the rotary engine of the invention and a condenser as well as optionally a recuperator.

The invention also relates to a vehicle, for example a passenger car or a truck comprising an internal combustion engine, wherein the vehicle comprises the waste heat recovery system according to the invention. The heat exchanger may be arranged such that exhaust waste heat can be transferred to the fluid. For example, an exhaust line may be next to the heat exchanger for transferring heat from the exhaust line. In general, it is sufficient if for example an exhaust line is in thermodynamic contact to a line of the fluid for forming the heat exchanger.

The rotary engine is described with two rotary pistons. In general, however, also further rotary pistons may be provided in the same inner room or in another inner room. Furthermore, the number of sealing strips and corresponding recesses may deviate from the numbers indicated with respect to the different embodiments.

The characteristics of the invention described as additional device features shall also be understood as variants of the method of the invention, and vice versa.

BRIEF DESCRIPTION OF THE DRAWINGS

Further features and advantages of the invention are described below with reference to the attached schematic figures in which.

DETAILED DESCRIPTION OF THE INVENTION

Similar components and components with similar effects are generally indicated with the same reference signs throughout the figures.

Figure 1:
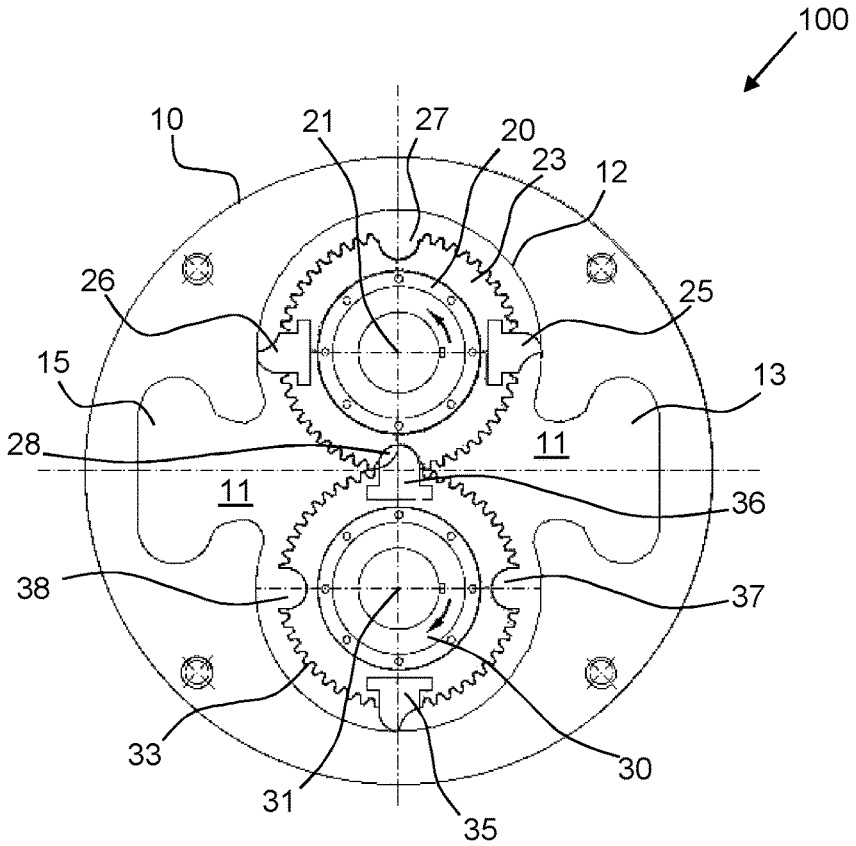
FIG. 1 is a cross-section of an embodiment of a rotary engine of the invention.
Figure 2:
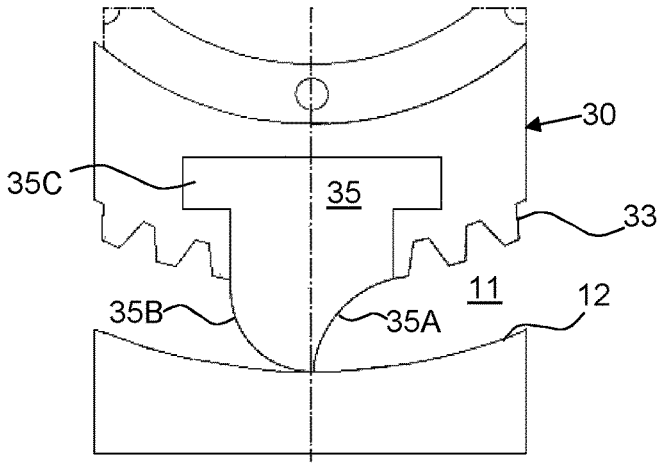
FIG. 2 is an enlarged detail of FIG. 1.

FIG. 1 shows schematically a cross-section of an embodiment of an inventive rotary engine 100. An enlarged detail thereof is shown in FIG. 2.

The rotary engine 100 is powered by a fluid which flows through it, and serves for converting energy of the fluid into rotational energy. To this end, the rotary engine 100 comprises as important components two rotary pistons 20 and 30 which are arranged in an inner room 11 which is limited by a housing inner surface 12 of a housing 10.

An inlet opening 13 which is not shown in more detail allows fluid to enter the inner room 11. The fluid may in principle be any liquid or also any gas or mixture of a liquid and gas.

An outlet opening 15 is furthermore provided at the inner room 11. If the fluid flows from the inlet opening 13 through the inner room 11 to the outlet opening 15, it must pass both rotary pistons 20, 30, and has to rotate these. The reference signs 21 and 31 mark the rotation axes of the two rotary pistons 20 and 30. The rotation axes 21, 31 extend into the drawing plane.

The design of the rotary pistons 20, 30 is decisive for an efficient functioning. The rotary pistons shall provide a sealing to each other and a sealing to the surrounding housing inner surface 12 so that the fluid cannot reach the outlet opening 15 if the rotary pistons 20, 30 do not move.

Simultaneously, the rotary pistons 20, 30 should be easily rotated by the fluid, i.e., the rotary pistons 20, 30 should already rotate at low pressure.

To this end, the two rotary pistons 20 and 30 comprise sealing strips 25, 26, 35, 36 at their respective outer surfaces.

The outer surfaces may be regarded as the shell surfaces of substantially cylindrical rotary pistons 20, 30. The sealing strips 25, 26, 35, 36 extend preferably over the whole height of the inner room 11, wherein the height may refer to a direction of the rotation axes 21, 31.

In some variants, the rotary piston 20 comprises at least two, preferably exactly two, sealing strips 25, 26. Similarly, the rotary piston 30 comprises at least two, preferably exactly two, sealing strips 35, 36. The sealing strips 25, 26, 35, 36 extend radially beyond the remaining outer circumference of the respective rotary piston 20, 30. In these variants, the sealing strips 25, 26, 35, 36 are preferably received in slots at the respective rotary piston 20, 30, and may preferably consist of a material different to the part of the rotary piston 20, 30 in which the slots are formed. The sealing strips 25, 26, 35, 36 consist of a deformable material, which may be, for example, rubber, resin or a plastic material. In this way the sealing strips 25, 26, 35, 36 may be slightly deformed by fluid flowing against it, and may thus be pressed against the housing inner surface 12. In this way a particularly good sealing to the housing inner surface 12 is achieved. In principle, the sealing strips 25, 26, 35, 36 may also consist of a rigid material, for example a metal. Alternatively or additionally the sealing strips 25, 26, 35, 36 may be received with some leeway in their respective slots, and thus the fluid pressure slightly tilts the sealing strips 25, 26, 35, 36. In this way the sealing strips 25, 26, 35, 36 may in principle also be pressed against the housing inner surface 12.

The two rotary pistons 20, 30 are arranged in the inner room 11 such that they contact each other. In this way, a fluid flow between the rotary pistons is substantially excluded. The rotation axes 21 and 31 may be parallel to each other. However, also a tilt between the rotation axes 21, 31 is possible as long as a substantially sealing contact between the rotary pistons 20, 30 is ensured.

To this end, the rotary pistons 20, 30 also each comprise a gear rim 23, 33 at the respective outer circumference, which gear rim is rigidly connected with the remainder of the corresponding rotary piston 20, 30. The two gear rims 23, 33 are sized and arranged to intermesh. Thereby the two gear rims 23, 33 rotate jointly and form hardly any free spaces between each other. It is thus hardly possible for fluid to flow between the two gear rims 23, 33.

Furthermore, the rotary pistons 20 and 30 comprise recesses 27, 28 and 37, 38, respectively, at their respective outer circumference. The number of recesses 27, 28 of the first rotary piston 20 is equal to the number of sealing strips 35, 36 of the second rotary piston 30. Similarly, the number of recesses 37, 38 of the second rotary piston 30 is equal to the number of sealing strips 25, 26 of the first rotary piston 20. Furthermore the recesses 27, 28, 37, 38 and the sealing strips 25, 26, 35, 36 are arranged at the two rotary pistons 20, 30 such that the sealing strips 25, 26 of the first rotary piston 20 mate with the recesses 37, 38 of the second rotary piston 30 when the two rotary pistons 20 and 30 rotate. Similarly the sealing strips 35, 36 of the second rotary piston 30 mate with the recesses 27, 28 of the first rotary piston 20. To this end, a recess and a sealing strip may alternate in 90° separations at the outer circumference of each rotary piston 20, 30, for example. In other words, the two sealing strips 25, 26 are distanced from each other by an azimuth angle of 180° (i.e., an angle of 180° about the rotation axes 21). Also the two recesses 27, 28 are separated from each other by an azimuth angle of 180°, and by an azimuth angle of 90° relative to the sealing strips 25, 26. This is analogously valid for the sealing strips 35, 36 and recesses 37, 38 of the other rotary piston 30. In general, also other angles are possible. Other azimuth angles result in particular when there are more than two sealing strips and two recesses per rotary piston 20, 30. Size and shape of the recesses are thus chosen such that the sealing strips may be received therein, in particular in a sealing manner.

Similar to the gear rims 23, 33, also the sealing strips 25, 26 35, 36 provide together with the recesses 27, 28, 37, 38 that fluid can hardly pass between the two rotary pistons.

Independent from a current rotary position, always one of the sealing strips 25, 26 35, 36 of each rotary piston 20, 30 shall provide a sealing to the housing inner surface 12. To this end a rotation angle is relevant over which one and the same sealing strip 25, 26 35, 36 causes a sealing to the housing inner surface 12. This rotation angle may be larger than 180°, as shown in FIG. 1, and may for example be between 185° and 240°. To this end, the housing wall 12 may have the shape of a segment of a circle at each rotary piston, wherein this shape forms a segment of a circle which is larger than 180° and thus forms more than a semi-circle.

FIG. 2 shows in greater detail the reception of the sealing strips 25, 26 35, 36 in their corresponding slots. For example, for all sealing strips 25, 26 35, 36, the sealing strip 35 is shown in its cross-section. The sealing strip 35 may have the shape of a profile, i.e., it may have the same cross-section throughout its length (in particular in the direction of the rotation axis 31). As shown, the cross-sectional shape forms a slot nut. Towards the inner end of the sealing strip, a collar 35C is formed, which engages with a T-shaped recess/slot. This inhibits that the slot nut may inadvertently come loose out of the slot of the rotary piston in a radial direction. Inserting and removing the slot nut 35 is possible in the longitudinal direction, i.e., in the direction of the rotation axis 31. By forming slot nuts, the sealing strips can be easily secured. Furthermore, also replacement is facilitated. This is relevant as gradual abrasion of the sealing strips 25, 26, 35, 36 may occur and may thus make a replacement necessary due to the sealing contact with the housing inner surface 12.

As shown in FIG. 1, the fluid in the inner room 11 pushes against the rotary pistons 20, 30 and those sealing strips 25, 35 that face the inlet opening 13 in the momentary rotary position of the rotary pistons 20, 30. This pressure causes rotation of the rotary pistons 20, 30 in the direction of the arrows shown in FIG. 1.

For the rotation and in particular for the sealing effect of the sealing strips 25, 35, the shape of the sealing strips is important. This is explained in more detail with respect to FIG. 2, which shows a sealing strip 35 which protrudes radially from the gear rim 33. The sealing strip 35 has a point of maximal radial extension or an edge which extends into the paper plane (or in the direction of the rotation axis 31). Starting from this edge, the sealing strip 35 has a surface 35A or fluid contact surface 35A facing the incoming fluid (this is valid for rotation positions in which the sealing strip 35 contacts the housing inner surface 12). On the opposite side of said edge, the sealing strip 35 comprises another surface 35B which is referred to as a rear side 35B. The rear side 35B does not face the incoming fluid when the sealing strip 35 contacts the housing inner surface 12.

The fluid contact surface 35A comprises a recess or a concave shape, whereas the rear side 35B has an outwardly curved or convex shape. In this way, the outer end of the sealing strip 35, i.e., the radially furthest extending part, is deformed transversely or approximately perpendicularly to the radial direction by the fluid flowing against it. The sealing strip 35 is thus pressed against the housing inner surface 12. In FIG. 2, the lower end of the sealing strip 35 is deformed approximately to the left and thus against the housing inner surface 12.

Advantageously, in this way a particularly good sealing may be provided, without however causing unduly high friction between the sealing strips and the housing inner surface. Advantageously, already at a comparably low fluid pressure, the rotary pistons may thus be set in rotation. Also fluids at low pressure may thus be used for energy use.

A possible application is the usage of exhaust waste heat of a combustion machine. For example, an internal combustion engine of a vehicle emits exhaust gases with heat that can, in principle, be used. The heat may be transferred with a heat exchanger to a fluid in a working fluid circuit. For instance, the working fluid may be compressed and then relaxed in a basically known Rankine cycle or organic Rankine cycle (ORC). Here, it passes an engine which generates a rotational movement with the energy of the fluid. The rotary engine according to the invention is used as such a motor. In particular with the exhaust waste heat, pressures are produced at which hitherto used motors have a rather low efficiency. In contrast, the rotary engine of the invention allows efficient usage of exhaust waste heat energy. The produced rotational energy may in principle be used in any manner. In particular, it may be converted into electrical energy, for example with a generator. The electrical energy may be fed in a board grid of the vehicle and/or may be stored in an electrochemical battery of another storage.

In the above embodiment a specific shape of the sealing strips is used. However, it must be stressed that also with other shapes generally suitable sealing properties may be provided, and the invention is not limited to the (preferred) shape of the sealing strips shown in the figures. It may thus suffice if the fluid contact surface or the rear side is formed as described. The other side may, for example, be flat or shaped like the other side. It is also possible that the described shapes of the fluid contact surface and the rear side are only formed at an end portion of the sealing strips and not across the whole part that radially protrudes beyond the corresponding gear rim. It may generally suffice for sufficient sealing properties if the sealing strips are deformable or movable relative to the gear rim and are, in particular, not formed integrally with the gear rim.

The invention claimed is:

1. A rotary engine comprising:

a housing defining an inner room, two rotary pistons arranged in the inner room, an inlet opening for letting a fluid into the inner room, and an outlet opening for the fluid defined at the inner room at a side opposite to the inlet opening, wherein each rotary piston comprises at least two sealing strips and at least two recesses at its outer circumference, wherein the sealing strips are sized to sealingly contact a housing inner surface in a radial direction, wherein the sealing strips are comprised of a deformable material, wherein each of the sealing strips comprises a fluid contact surface facing inflowing fluid when the respective rotary piston is at a rotation angle position at which said sealing strip contacts the housing inner surface, wherein the shapes of the recesses and the sealing strips are sealingly engaged with the sealing strips of each one of the rotary pistons with the recesses of the respective other rotary piston, and wherein the fluid contact surface of each sealing strip has a concave shape.

2. The rotary engine as defined in claim 1, wherein each of the sealing strips has a rear side which is opposite the fluid contact surface and which does not face inflowing fluid when the respective rotary piston is at a rotation angle position in which said sealing strip contacts the housing inner surface, and wherein the rear side has a convex shape.

3. The rotary engine as defined in claim 1, wherein each rotary piston comprises at its respective outer circumference slots for receiving and securing the sealing strips and wherein the sealing strips are formed as slot nuts for securely coupling with the slots of the respective rotary piston.

4. The rotary engine as defined in claim 3, wherein the slots are formed as T-slots and each of the slot nuts respectively comprises a laterally protruding shroud for engaging with one of the T-slots.

5. The rotary engine as defined in claim 1, wherein each rotary piston comprises two sealing strips at opposite angle positions at its outer circumference, and wherein each rotary piston comprises exactly two recesses arranged at the outer circumference at angle positions which are each offset by 90° relative to the angle positions of the two sealing strips.

6. The rotary engine as defined in claim 1, wherein the sealing strips are sized such that, and a housing inner surface is formed such that the sealing strips sealingly contact the housing inner surface within a rotary angle range of the rotary piston.

7. The rotary engine as defined in claim 1, wherein each rotary piston comprises a gear rim at its outer circumference, and the rotary pistons are arranged such that their gear rims mesh.

8. The rotary engine as defined in claim 7, wherein the sealing strips protrude from their respective rotary piston further outwards in a radial direction than the respective gear rim.

9. The rotary engine as defined in claim 7, wherein the sealing strips protrude from the respective gear rim by a radial distance which is between 5% and 30%, in particular between 10% and 25%, of a radius of the gear rim.

10. The rotary engine as defined in claim 1, wherein an end portion of each fluid contact surface has a concave shape.

11. A waste heat recovery system comprising:

a working fluid circuit in which a fluid circulates, a heat exchanger in which heat can be transferred from a medium to the fluid in the working fluid circuit, wherein the working fluid circuit is formed as a thermodynamic cycle, in particular as an organic Rankine cycle, and comprises means for converting heat energy of the fluid into motion energy, wherein the working fluid circuit comprises a rotary engine as defined in claim 1, in which fluid flowing through undergoes a pressure reduction and thus causes rotation of the rotary pistons.

12. The waste heat recovery system as defined in claim 11, wherein a generator is provided and configured to convert rotational energy of the rotary engine into electrical energy.

13. The waste heat recovery system as defined in claim 11, wherein the waste heat recovery system is part of a vehicle, and wherein the heat exchanger is arranged to transfer heat from exhaust gas to the fluid.

14. A method for operating a rotary engine, the method comprising:

introducing a fluid through an inlet opening into an inner room of a housing of the rotary engine, providing in the inner room two rotary pistons which are rotated by the fluid, wherein each rotary piston comprises at its outer circumference at least two sealing strips and at least two recesses, wherein the sealing strips are each sized in radial direction for sealingly contacting a housing inner surface, wherein the sealing strips are each comprised of a deformable material, wherein each of the sealing strips comprises a fluid contact surface facing inflowing fluid when the respective rotary piston is at a rotation angle position at which said sealing strip contacts the housing inner surface, wherein the shapes of the recesses and the sealing strips are sealingly engaged with the sealing strips of each one of the rotary pistons with the recesses of the respective other rotary piston, wherein the fluid coming from the inlet opening pushes against some of the sealing strips, whereby said sealing strips are pushed against the housing inner surface, and wherein the fluid contact surface of each sealing strip has a concave shape.

* * * * *